US008752900B2

(12) United States Patent
Carter, III

(10) Patent No.: US 8,752,900 B2
(45) Date of Patent: Jun. 17, 2014

(54) MODULAR CHAIR

(76) Inventor: Leonard Clyde Carter, III, Roanoke, VA (US)

( * ) Notice: Subject to any disclaimer, the term of this patent is extended or adjusted under 35 U.S.C. 154(b) by 127 days.

(21) Appl. No.: 13/441,517

(22) Filed: Apr. 6, 2012

(65) Prior Publication Data

US 2013/0147244 A1 Jun. 13, 2013

Related U.S. Application Data

(63) Continuation-in-part of application No. 29/408,325, filed on Dec. 9, 2011, now Pat. No. Des. 666,424.

(51) Int. Cl.
*A47C 7/00* (2006.01)

(52) U.S. Cl.
USPC ..... 297/440.14; 297/440.22

(58) Field of Classification Search
USPC ..... 297/217.6, 440.16, 440.1, 440.14; 108/184, 190, 27
See application file for complete search history.

(56) References Cited

U.S. PATENT DOCUMENTS

| | | | | | |
|---|---|---|---|---|---|
| 2,251,544 | A | * | 8/1941 | Jiranek | 297/145 |
| 2,793,685 | A | | 5/1957 | Spitz | |
| 3,036,864 | A | | 5/1962 | Zentaro | |
| 3,171,690 | A | | 3/1965 | Weiss | |
| 3,183,036 | A | * | 5/1965 | Hill | 297/440.22 |
| 3,608,959 | A | | 9/1971 | Sarvas | |
| 3,695,691 | A | * | 10/1972 | Putnam | 297/223 |
| 3,756,657 | A | * | 9/1973 | Johnson | 297/440.1 |
| D234,171 | S | | 1/1975 | Long | |
| D239,580 | S | | 4/1976 | Robertson | |
| D241,095 | S | | 8/1976 | Friedman | |
| 4,022,502 | A | | 5/1977 | Smith et al. | |
| D249,849 | S | | 10/1978 | Schoeller | |
| D251,938 | S | | 5/1979 | Spound et al. | |
| 4,188,066 | A | | 2/1980 | Terenzoni | |
| D263,770 | S | | 4/1982 | Melchior | |
| D282,606 | S | | 2/1986 | De Fuccio | |
| D283,562 | S | | 4/1986 | Raftery | |
| 4,602,817 | A | | 7/1986 | Raftery | |
| D288,748 | S | | 3/1987 | Klein | |
| D292,145 | S | | 10/1987 | Zapf | |
| 4,951,181 | A | | 8/1990 | Phillips | |
| 5,080,438 | A | | 1/1992 | Moyer | |
| 5,112,110 | A | * | 5/1992 | Perkins | 297/440.21 |
| 5,329,716 | A | * | 7/1994 | Fite | 297/217.6 |
| D360,311 | S | | 7/1995 | Stamberg | |
| D367,364 | S | | 2/1996 | Lewis | |
| 5,529,380 | A | | 6/1996 | Blansett | |
| D375,845 | S | | 11/1996 | Mourgue | |
| 5,727,849 | A | * | 3/1998 | Nelson | 297/440.16 |
| 5,918,932 | A | * | 7/1999 | Morrison et al. | 297/217.6 |
| D440,413 | S | | 4/2001 | Binder et al. | |
| 6,241,317 | B1 | | 6/2001 | Wu | |

(Continued)

*Primary Examiner* — Jose V Chen
(74) *Attorney, Agent, or Firm* — New River Valley IP Law, PC; Michele L. Mayberry

(57) ABSTRACT

Modular furniture is provided. More specifically, upholstered furniture, including chairs, sofas, loveseats, and beds that are operably configured for removing and/or replacing one or more component of the furniture, such as arm rests, support legs, backs and sides are provided. In particular, an upholstered chair comprising: a base having a seat fixedly connected with a backrest; and a plurality of glass block sides removeably connected with the base is provided. The modular furniture systems can be used by consumers to replace selected components of the furniture with updated components for a new look.

7 Claims, 4 Drawing Sheets

(56) References Cited

U.S. PATENT DOCUMENTS

| | | | | |
|---|---|---|---|---|
| 6,367,880 | B1 | 4/2002 | Niederman et al. | |
| 6,783,182 | B1 * | 8/2004 | Gallagher | 297/440.14 |
| 6,796,614 | B1 | 9/2004 | Paul | |
| D538,054 | S | 3/2007 | Lissoni | |
| D615,308 | S | 5/2010 | Serra Sola et al. | |
| D666,424 | S * | 9/2012 | Carter, III | D6/334 |
| 8,511,752 | B2 * | 8/2013 | Grove | 297/440.1 |
| 2004/0212240 | A1 * | 10/2004 | Zwezdaryk | 297/440.1 |
| 2010/0093257 | A1 * | 4/2010 | Elliott | 297/440.14 |
| 2012/0098306 | A1 * | 4/2012 | Jarnagin et al. | 297/217.6 |

* cited by examiner

MODULAR CHAIR

CROSS-REFERENCE TO RELATED APPLICATIONS

This application is a Continuation-in-Part Application of and claims priority to and the benefit of the filing date of U.S. Design patent application Ser. No. 29/408,325, which was filed Dec. 9, 2011, now U.S. Pat. No. D666,424 the disclosure of which is hereby incorporated by reference herein in its entirety.

BACKGROUND OF THE INVENTION

1. Field of the Invention

The present invention relates to modular furniture. More specifically, embodiments of the present invention relate to upholstered furniture, including chairs, sofas, loveseats, and beds that are operably configured for removing and/or replacing one or more component of the furniture, such as arm rests, support legs, backs and sides.

2. Description of Related Art

Furniture, especially upholstered furniture, is typically manufactured as a single unit without the capability of changing the look. Styles change over time, however, and having the latest style furniture often means replacing the furniture as a whole. The purchase of quality upholstered furniture is an expensive endeavor for most consumers and is thus an investment most consumers will retain until the furniture wears out.

Slip covers are a very popular alternative to replacing furniture and can often result in updating or changing the overall look of the furniture. One-size-fits-most type slip covers cannot meet the needs of all consumers and accommodate the variety of furniture that is available. Additionally, even though slip covers are available as one-size-fits-most, slip covers will not provide a precise fit for every type of furniture and usually result in a compromise of one's aesthetic taste in that the overall look of the furniture is changed in a less than desirable manner. Slip covers also tend to give a more casual appearance to furniture, which may not be desired by consumers of more contemporary styles. Custom slip covers or re-upholstering of the furniture are alternatives, but may cost as much as replacing the furniture in some cases and so may not be a viable option. Re-upholstering the furniture may allow for specific components of the furniture to be replaced but the task requires skill and most consumers cannot do the replacing easily or conveniently. Thus, re-upholstering is often performed by an expert rather than the do-it-yourselfer.

Another way to change the look of furniture is to rent the furniture and replace one or more pieces when the consumer grows tired of it or the furniture wears out. One disadvantage of renting is that the overall cost of renting furniture is in most cases higher than making an investment in buying furniture. Another disadvantage is that if the consumer damages the furniture, it will cost the consumer extra to have it repaired or otherwise cover the cost of the damage. In any case, renting furniture does not allow for replacing specific components of the furniture.

Sectional type furniture is also available. This type of furniture allows the consumer to change the overall configuration of a piece of furniture but not the overall appearance. For example, some sectionals allow for a sofa with four seats to be modified to a loveseat having only two seats by removing two seat components from the sectional. Sectional furniture typically does not allow for only the sides, armrests, or legs of the furniture to be replaced with the same component of a different style.

An example of modular furniture that can be reconfigured by adding, removing or repositioning certain of the constituent components in order to change the appearance or functional capacity of the furniture is provided by U.S. Pat. No. 6,796,614, entitled "Modular Furniture Unit," the disclosure of which is hereby incorporated by reference herein in its entirety. This patent discloses furniture comprising a base with a plurality of slots for receiving a tongue portion of a furniture module for releaseably securing the furniture module to the base, where the slots are covered by a cover member and are revealed when needed to insert a module. The furniture can be reconfigured or reshaped by adding, removing or repositioning constituent furniture modules. What is lacking, however, is interchangeable modules having a variety of aesthetic appearances to provide for substituting one or more components with a similar modular having a different aesthetic appearance.

Other examples of modular furniture known in the art include that described in U.S. Pat. No. 5,529,380, entitled "Apparatus and Method for Forming a Frame for an Article of Furniture," which is incorporated by reference herein in its entirety. This reference discloses a modular furniture system that allows the furniture unit to be disassembled, and even the covering changed. Conventional modular furniture requires that brackets be lined up and held in place while bolts are installed, making it difficult for an individual to complete the task without the assistance of an additional person. Thus, the process required to effect these changes is time consuming and possibly confusing to a homeowner who is not handy with tools.

Even further, U.S. Pat. No. 6,367,880, entitled "Modular Upholstered Furniture Construction," describes a modular furniture system, comprising a base frame and a plurality of furniture modules including a first arm module, a second arm module, a backrest module and a seat suspension module, with a plurality of fastener assemblies having a stud member and an aligning receptacle bracket; one of said stud member and said bracket being secured to opposing locations of said base frame and at least one of said modules so that said modules may be positioned upon said frame by engaging said aligning receptacle brackets upon said corresponding stud members without the use of tools. Such stud/bracket combinations are difficult to assemble in that the stud members must be aligned exactly with the brackets in order to assemble the furniture correctly.

Modular furniture has additional limitations, including the types of materials that can be used. For example, glass block is a popular design element not often used in furniture. Upholstered furniture, including sofas and chairs, generally do not incorporate a glass block feature presumably because fabric and glass block are vastly different and as such typically require vastly different means for securing them within the furniture structure. Less frequent is the notion of lighted upholstered furniture, presumably because the upholstery typically used is purposely not transparent to hide the inner workings or structure of the furniture. It has been proposed to use lighted glass block in tables, however, as disclosed in U.S. Pat. No. 4,951,181, entitled "Light Diffusing Glass Block Furniture," the disclosure of which is hereby incorporated by reference here in its entirety. Unfortunately, the reference does not provide guidance on how to incorporate lighted glass block into upholstered furniture, which is a challenging design conundrum in that in some circumstances a fire hazard may be presented.

What is needed is furniture that is modular in nature such that its component parts can be conveniently replaced with the same component of a different style. The modular furniture should be simple to assemble and allow for an unlimited number of style changes. Preferably, the modular furniture comprises kits with lighted glass block modules.

SUMMARY OF THE INVENTION

To this end, embodiments of the present invention provide modular furniture with components that are easily interchangeable with replacement components to change the appearance of one or more component parts of the furniture. Component parts of the furniture that can be exchanged for another part of the same configuration yet having a different aesthetic appearance include arm rests, legs and/or feet, and arms of the furniture.

Of particular interest is modular furniture comprising glass block. The glass block is typically incorporated into the furniture as arm modules. One or more of the glass blocks can be replaced with another glass block having different style features. For example, in embodiments, an entire glass block arm module can be replaced with a glass block module having a different design, or an upholstered, or leather, or wood arm module. Similarly, the glass block arm module can be transparent, or semi-transparent or frosted, etched on the surface of the glass block and one or more of the glass blocks of the glass block module can be replaced with a glass block of a different style. Preferably, the glass block arm modules comprise a lighting element, such as LEDs for illuminating one or more of the glass blocks.

Provided is a modular furniture system comprising: a base comprising a seat, backrest, and two arm module frame members each disposed on opposing sides of the seat and each forming an upright u-shaped track fixedly connected with the backrest and seat; and an arm module releaseably disposed within each arm module frame member.

Such systems can comprise armrests releaseably disposed on the arm module frame members, such as by fastening the armrests to the furniture using hook and loop type or post and hole type fasteners.

Further, such systems can comprise legs releaseably disposed on the base.

Preferred are such systems comprising a glass block arm module. The glass block arm module can comprise glass block individually releaseably disposed in the u-shaped track. Even further, the furniture systems can comprise LEDs for illuminating the glass block.

Specifically provided is an upholstered chair comprising: a base comprising a seat fixedly connected with a backrest; and a plurality of glass block sides removeably connected with the base.

In upholstered chairs of the invention the individual glass blocks can be replaceable. Additionally, the upholstered chairs can comprise LEDs for illuminating the glass block sides.

Also provided by embodiments of the invention is a modular furniture kit comprising: a base member; a plurality of armrests, legs, and sides operably configured for releasable engagement with the base member. Such kits preferably comprise at least one side (e.g., arm module) comprising glass block.

BRIEF DESCRIPTION OF THE DRAWINGS

The following drawings illustrate certain aspects of some embodiments of the present invention and should not be used to limit the invention. Together with the written description, the drawings serve to explain and illustrate certain principles of the invention.

DETAILED DESCRIPTION OF PREFERRED EMBODIMENTS

Reference will now be made in detail to various exemplary embodiments of the invention. The following detailed description is presented for the purpose of describing certain embodiments in detail and is, thus, not to be considered as limiting the invention to the embodiments described. Rather, the true scope of the invention is defined by the claims.

Although in this specification an example is provided which explains details of the invention in the context of a 1-cushion or single seat chair, other embodiments are also possible such as a 2-cushion loveseat, or a 3-cushion or 4-seat sofa.

Embodiments of the present invention provide furniture of a modular design. Objects of the present invention provide modular furniture that comprises an upholstered portion, such as a fabric seat(s) or back, with a glass block portion, such as arms. Preferred is such furniture that comprises LED lighting to illuminate the glass block.

Figure 1:
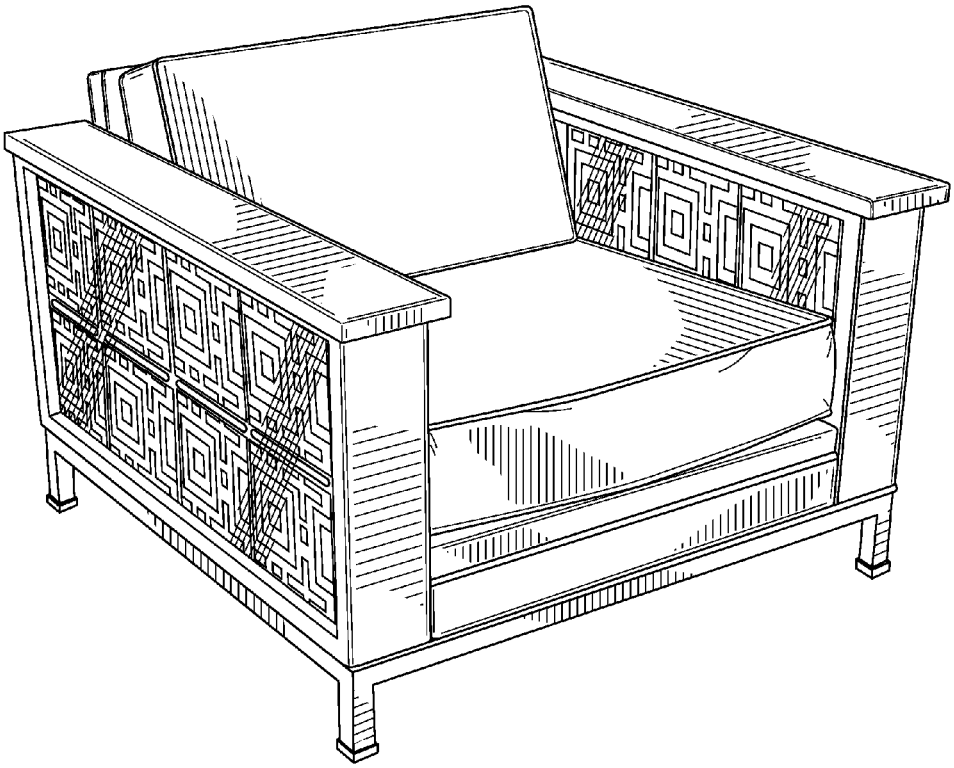
FIG. 1 is a schematic rendering of a chair embodiment of the invention.

Referring now to FIG. 1, a partially upholstered chair is provided comprising a base with four legs or feet and an upholstered back, front arms, and seat and back cushions. In this embodiment, partially upholstered refers to the chair being only partially covered in a fabric and some features or external surfaces of the chair being a different material. The fabric can be of any type, including cloth, soft plastic, or leather to name a few. Although in this embodiment, the legs are shown in a metal version attached to a metal base, the legs and frame can also be covered in fabric so that the entire exposed surface of the chair is upholstered or covered in fabric. If only partially upholstered, the portions of the chair not covered in fabric can be wood, metal, or hard plastic.

The furniture comprises two arm modules on either side of the furniture. Disposed between the arm modules is the seat and/or cushion. As shown, the frame of the furniture consists of a base portion, a back portion, and framing for the arm modules. These parts of the chair, in embodiments, always remain fixed relative to one another and are not substitutable for other components nor are they intended to be replaced by the consumer quickly and easily.

Figure 2:
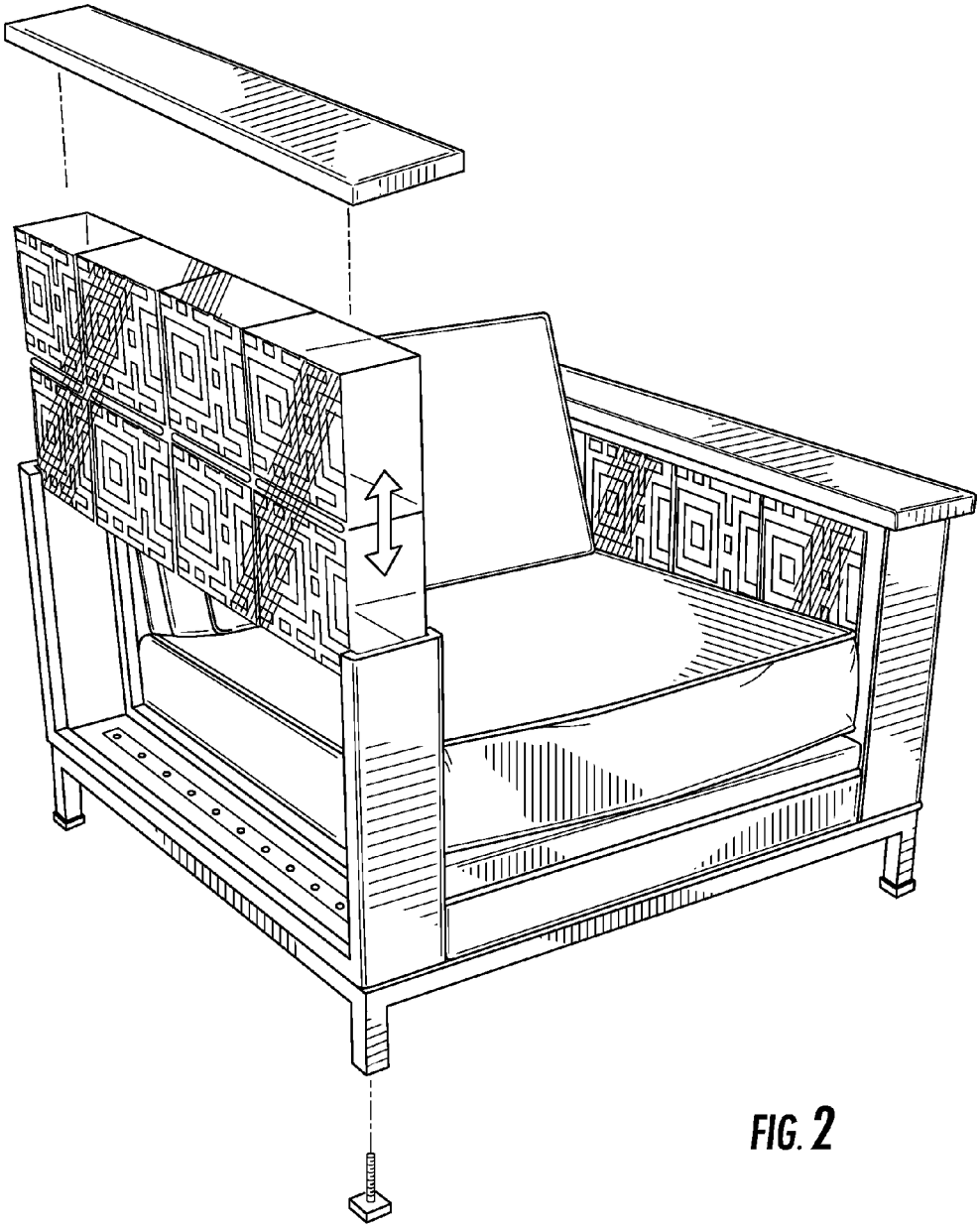
FIG. 2 is a schematic drawing of a chair embodiment of the invention, illustrating an arm module comprising glass block.
Figure 3:
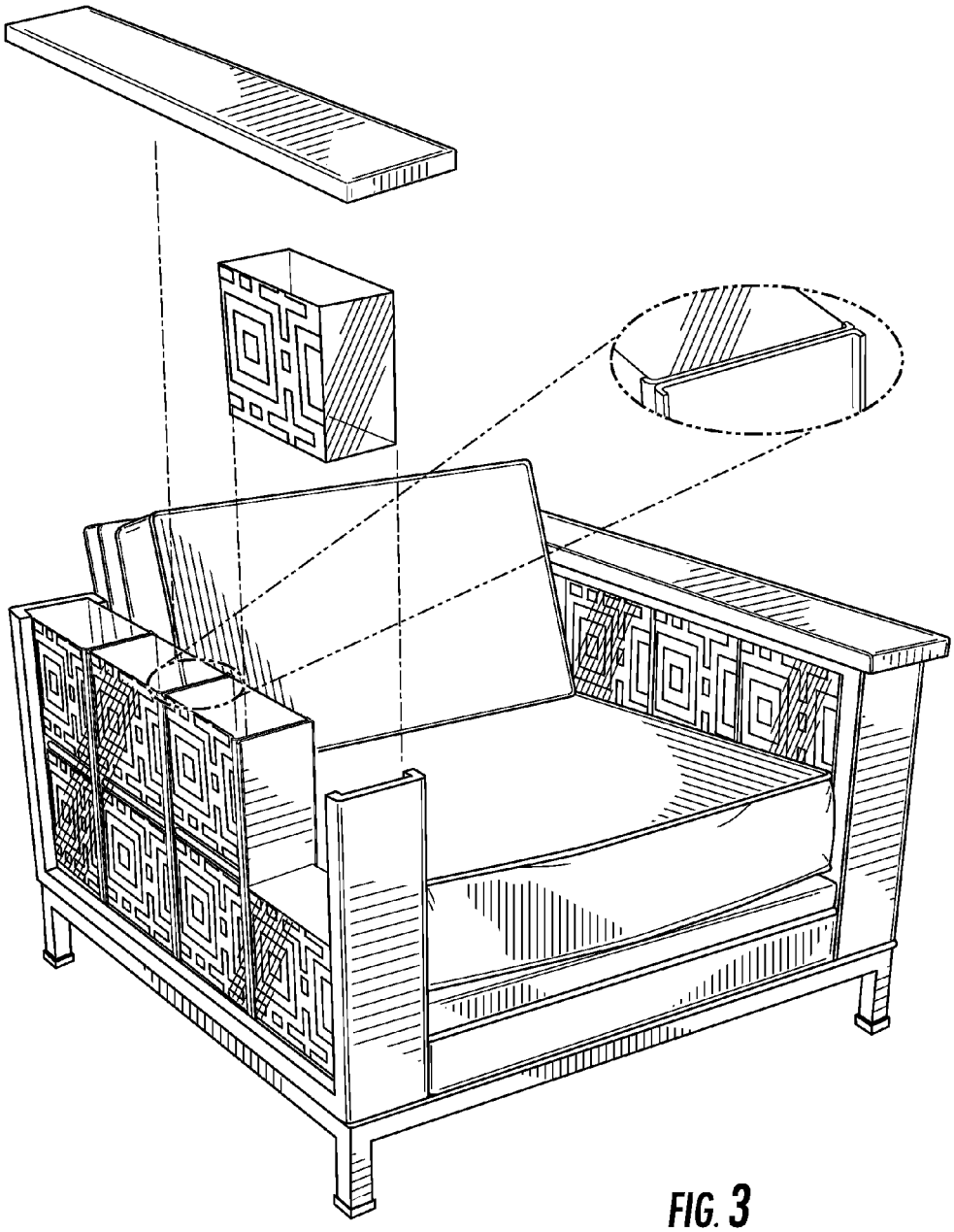
FIG. 3 is a schematic drawing of a chair embodiment of the invention, illustrating an arm module comprising individually interchangeable glass blocks.

For example, the frames for the arm modules can comprise an upwardly facing u-shaped track in which an arm module can be disposed. A set of eight standard glass blocks can be bonded together to form an arm module which is capable of being inserted as a unit into the u-shaped track of the furniture as shown in FIG. 2. Alternatively, additional guide or track members can be used for supporting the glass blocks as individual components. With eight individual standard 8-inch square glass blocks not bonded together, three additional vertical support tracks and one additional horizontal support track can be used to ensure the glass block is held securely in place within the arm module once assembled as shown in FIG. 3. These additional framing components are preferably not fixed components of the furniture and are used only when individual glass block is used. These additional framing components are not needed for single piece arm modules that have a perimeter that fits snugly within the u-shaped frame.

The glass blocks can be changed out to accommodate different style blocks and/or surfaces. For example, the sides of the furniture (i.e., the arm modules) can be any one of acrylic or plastic blocks, corrugated or smooth plastic panels, metal panels, upholstered leather panels, fabric or upholstered, etc. The sides can be changed out at a later date with any one of the other materials to allow design versatility for additional models down the road. Because the furniture is modular, the consumer can easily make these changes when desired.

More specifically, the eight block modular panel can be exchanged for another 8-block panel. It may be desired to have a transparent glass block panel at one time, then change the look of the furniture by swapping out the transparent panel for a frosted panel. Alternatively, the panel can be swapped out for a panel that has a combination of transparent and frosted glass blocks. Likewise, etched glass block can also be incorporated into the panels into one or more of the glass blocks. In the context of this specification, a panel refers to the entire exposed surface of the arm module when disposed in the furniture.

For example, an outer u-shaped track is disposed in the frame of the furniture and is configured for receiving and holding a number of glass blocks or a panel of glass blocks bonded together. It is not critical how the glass block is bonded together to form the panel and any type of adhesive or grout can be used. The panel is dropped vertically into the u-shaped track and a lip is disposed around the track for retaining the glass block in place in the track. Preferably, the lip is disposed at a 90 degree angle relative to the members forming the u-shaped track and to some extent acts as a picture frame around the glass block panel. Once the panel is in place, the armrest can be secured over the top of the panel along the side of the panel that is the opening to the u-shaped track to lock the arm module in position. Similarly, the glass block panel can be replaced with a leather panel that is inserted into the u-shaped track in the same manner and locked in place by securing the armrest in place. Preferably, the leather panel or any type of substitute panel including wood, corrugated metal, or plastic is a modular arm module of the same dimensions as the glass block panel to provide for a secure fit within the u-shaped track. Only the portion of the arm module exposed by the frame of the u-shaped track needs to be covered with the desired replacement material, as the remaining portions of the module will be hidden within the furniture.

In embodiments, the arm module can also comprise independently replaceable glass blocks, where one or more of the glass blocks can be exchanged for another glass block of the same type or of a different style. Indeed, one or more of the glass blocks can be replaced with an upholstered block, a wooden block, a transparent block, an etched block, a frosted block, a plastic block, a stone block, and so on. Once the existing glass block panel or glass blocks are removed, four replacement blocks are inserted into the u-shaped channel to form a first row of blocks of the substitute panel. Three vertical frame supports are then inserted into the three interior joints between the four blocks. A horizontal frame support is also inserted along the top of the first row of blocks. A second row of four blocks is then added on top of the first row to complete the panel. If blocks smaller than standard 8 inch glass blocks are used, a number of vertical and horizontal supports corresponding to the number of internal joints between the blocks is also used. Likewise, if the blocks are larger or if there are only vertical and no horizontal joints or if there are horizontal and no vertical joints, then a corresponding number and type of internal frame supports should be used to correspond to the actual needs of the system. In this way, any one or more of the blocks can be replaced. Ideally, the internal horizontal and vertical frame supports can be removed and/or repositioned within the u-shape frame so that a panel needing no such supports can also be used in the modular system.

Lighting can also be incorporated as a feature of the chair. Preferably LEDs can be used to illuminate the glass block sides. The LEDs are disposed in the chair in a manner to keep the LEDs hidden from view but to allow diffuse light to emerge from the glass block panels or other arm modules that are transparent or semi-transparent. A solar receptor can be provided on an exposed surface of the furniture which can be positioned to receive light to power the LED lighting for the furniture.

Additional components that can be replaced include the armrests. For example, the armrest can be secured in place on the arm module by way of co-operating tracks or brackets on the armrest and the arm module. When desired, the armrest can be released by a lever disposed on the back underside of the armrest and when released allows the armrest to slide forward for removal. A replacement armrest can slide onto a track and snap into place. Likewise, the armrest can be disposed within the u-shaped track using an interference fit or a latch-type mechanism for locking the armrest and the arm module in place. Preferred are hidden locking mechanisms which cannot be seen once the furniture is assembled for use. The armrest can also be hinged to the u-shaped frame, such that it can be lifted and rotated up and away from the frame to allow for insertion and removal of the arm modules into the u-shaped track. Similarly, a fourth side to the frame for receiving and securing the arm module in place can be used to close the u-shaped track and form a square or rectangular frame for holding the arm modules in place. This upper frame member can simultaneously be used to support an armrest. For example, the upper frame member (i.e., a fourth side added to the u-shaped track) can be hinged to one corner of the u-shaped track and opened for removing the arm module then closed when the arm module is disposed therein. On the upwardly facing surface of the upper frame member of the track can be disposed a bracket for receiving an armrest in a slideable manner. The underside of the armrest modules would have a cooperating bracket. Once the arm module is disposed in the u-shaped track, the upper frame member of the track can be hinged closed, and the armrest can be slid into place on the upper surface of this frame member. In this manner, the furniture can be adapted to a variety of looks. Further, for example, the armrests and feet can be provided in a wood finish, including poplar, pine, cherry, walnut, mahogany, or oak, or provided in a metal finish, such as brushed aluminum or chrome, or even in solid gloss colors.

It is not critical how the armrest is attached to the chair. Indeed, the armrest need not slide into place but can instead comprise posts or studs for inserting into corresponding holes of the upper frame member. Likewise, the posts or studs can be disposed on the upwardly facing surface of the upper frame member to be received by corresponding holes disposed in the underside surface of the armrest. In the context of this specification, terms of direction, such as upwardly and underside, are intended to refer to furniture disposed in an upright, ready to use manner. Even further, a hook and loop type fastener may be used to secure the armrest in place over the arm module, where one portion of the fastener (such as the hook side) is secured to the underside of the armrest and the cooperating portion of the fastener (such as the loop side) is secured to the upwardly facing surface of the upper frame member. In this manner, when the armrest is secured in place, the fasteners retaining the armrest in place are hidden completely from view. Although only a few examples are provided for ways of securing the modules in place, any number and type of means can be used. Preferred are fasteners that are hidden from view when the furniture is assembled for use.

Instead of the entire arm module being replaced, the sides of the furniture can be substituted for a side of a different material or a newer side in case the one being replaced is worn beyond repair. Glass block or glass block panels can be exchanged for solid panels, such as wood, upholstered, leather, glass, stained glass, etched glass, and plexi-glass panels. In embodiments, the side panels can be incorporated over the glass block panels instead of replacing the entire glass block arm module. For example, a thin panel of a different material can be inserted between the outwardly facing surface of the glass block panel and the u-shaped frame to make for quick and easy "re-upholstering."

Ornamental feet can be added to the feet of the chair or the provided feet can be exchanged for other feet. If added to the existing feet, the extension can be configured for placement directly over the feet, such as an end cap. Further, in this manner, the feet may act as levelers as a function of how far the feet or the extensions are screwed into the furniture. Decorative feet can also slide up over the leg like a cap. Round or square shapes are non-limiting options and the feet can be provided in a variety of colors.

The furniture can also be equipped with other conveniences, such as a hidden magnet under the fabric of the chair for securing a remote to the furniture. A magnet can be attached to a remote and held in place on the face of the chair by having the two magnets attract one another through the fabric of the chair.

Figure 4:
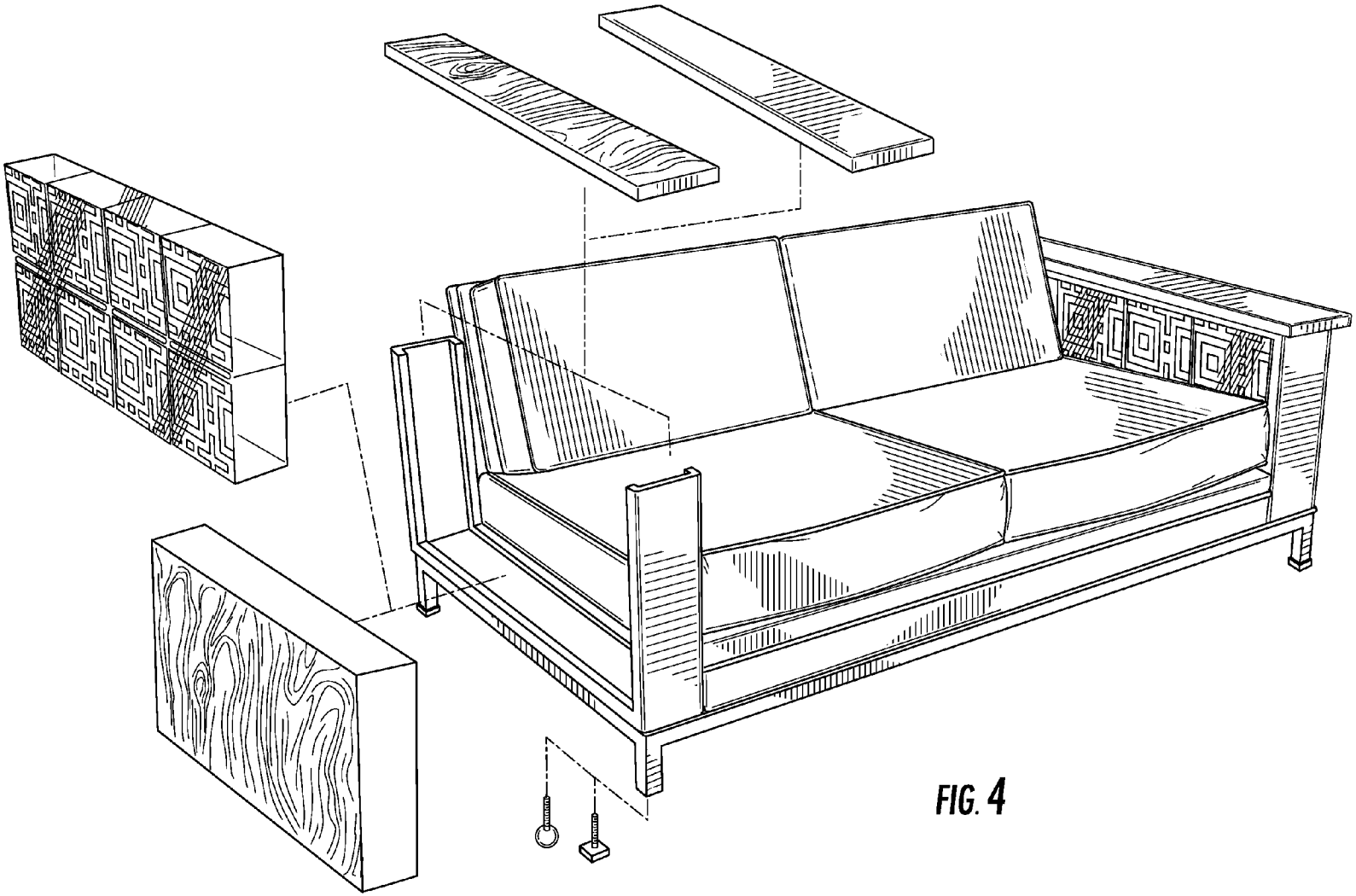
FIG. 4 is a schematic drawing of a modular kit or system of the invention, which is a modular loveseat comprising a glass block arm module that is interchangeable with another module such as a solid wood or wood veneer arm module.

The upholstered furniture according to embodiments of the invention can be provided to consumers as modular furniture kits. For example, the furniture can be sold as a base member with a plurality of modules that can replace certain components of the furniture as shown in FIG. 4. The base member typically can comprise a seat and a back with frame members for holding the arm modules. These features of the base member are typically fixed relative to one another and are not interchangeable with other seat or back members. When referring to a seat, back, or backrest member in the context of this specification, it is meant to include the base or support for those features rather than the seat or back cushions themselves, which can be incorporated into the furniture as fixed components or as preferably replaceable components. The kits of the invention can comprise a plurality of armrests, legs, and sides operably configured for releasable engagement with the base member. Such kits preferably comprise at least one side (e.g., arm module) comprising glass block. Preferably, the kits comprise several armrests, several legs, and several arm modules with at least one or at least one of each being of a different aesthetic design, fabric, type, or color than the remaining components. The kits can be configured in any manner that provides for the components in a releaseably engageable manner, and especially as described above for making replacement of the components functional. Indeed, any mechanism known for securing components in place can be used to secure the modules within the furniture structure. This includes any of the patents mentioned in this specification in the description of the related art and further for example any of the following patents, U.S. Pat. Nos. 6,241,317, 4,602,817, 3,036,864, 3,608,959, 4,022,502, 2,793,685, 3,171,690, 5,080,438, each of which is hereby incorporated by reference herein in their entireties.

The modular furniture systems of the present invention provide consumers with options for updating their furniture collections without the expense of replacing or traditional re-upholstering. With embodiments of the invention consumers can replace one or more components of their furniture at any time, easily and conveniently. In addition to consumers benefitting from the invention, the inventive furniture can be used in commercial applications as well. For example, it may be desired to have different types of furniture available for set designs without taking up valuable space in the theater or production studio. With embodiments of the invention, a single chair base or single sofa base can be present with unlimited numbers of replacement armrests, arm modules or sides available to create furniture pieces with a different look. Even further, hotels may benefit from the invention in that common areas or living room areas of the hotel and hotel rooms can be updated easily and conveniently to coordinate with other updates made, such as carpet and/or paint changes.

The present invention has been described with reference to particular embodiments having various features. It will be apparent to those skilled in the art that various modifications and variations can be made in the practice of the present invention without departing from the scope or spirit of the invention. Further, one skilled in the art will recognize that the features of embodiments of the invention may be used singularly or in any combination based on the requirements and specifications of a given application or design, and one or more elements, constituents, or process steps may be omitted, incorporated, or altered as desired. Other embodiments of the invention will be apparent to those skilled in the art from consideration of the specification and practice of the invention. It is intended that the specification and examples be considered as exemplary and that variations that do not depart from the essence of the invention are intended to be within the scope of the invention.

The present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. It should be evident that the particular illustrative embodiments disclosed above may be altered or modified and all such variations are considered within the scope and spirit of the present invention. The terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A modular furniture system comprising:

a base comprising a seat, backrest, and two arm module frame members each disposed on opposing sides of the seat and each forming an upright u-shaped track fixedly connected with the backrest and seat;

wherein the u-shaped track is shaped to receive and secure two sides and a bottom portion of an arm module when disposed therein; and a glass block arm module comprising a plurality of glass blocks and releaseably disposed within each arm module frame member in a manner such that the arm module is capable of being vertically dropped into or removed from the u-shaped track.

2. The system of claim 1 comprising legs releaseably disposed on the base.

3. The system of claim 1, wherein each glass block arm module is individually releaseably disposed in the u-shaped track.

4. The system of claim 1 comprising LEDs for illuminating the glass block arm module.

5. An upholstered chair comprising:

a base comprising a seat fixedly connected with a backrest by arm module frame members disposed on opposing sides of the seat and fixedly connected with the backrest and seat; and a plurality of glass block sides removeably connected with the base;

wherein each glass block side is a panel of multiple glass blocks and each panel is disposed within a track of the arm module frame member.

6. The upholstered chair of claim 5, wherein individual glass blocks of the panels are replaceable, and wherein each panel is disposed within the track in a manner such that the panel is capable of being vertically dropped into or removed from the track.

7. The upholstered chair of claim 6, wherein each frame member comprises LEDs for illuminating the glass blocks.

* * * * *